United States Patent [19]

Haas

[11] Patent Number: 4,564,087

[45] Date of Patent: Jan. 14, 1986

[54] DOUBLE PANEL SLIDING DOOR, ESPECIALLY FOR ELEVATORS

[75] Inventor: Max Haas, Kriens, Switzerland

[73] Assignee: Inventio AG, Hergiswil, Switzerland

[21] Appl. No.: 479,656

[22] Filed: Mar. 28, 1983

[30] Foreign Application Priority Data

Apr. 2, 1982 [CH] Switzerland ..... 2040/82

[51] Int. Cl.[4] ..... B66B 13/30; E05D 15/08

[52] U.S. Cl. ..... 187/56; 16/101; 16/102; 49/409

[58] Field of Search ..... 187/51, 56, 57; 16/97, 16/101, 102; 49/409

[56] References Cited

U.S. PATENT DOCUMENTS 2,611,920 9/1952 Borden .
2,904,848 9/1959 Lieberenz ..... 49/409
4,268,996 5/1981 Allen ..... 49/212

FOREIGN PATENT DOCUMENTS 1238668 7/1960 France .
2039578 12/1982 United Kingdom .

*Primary Examiner*—Joseph J. Rolla
*Assistant Examiner*—Frederick R. Handren
*Attorney, Agent, or Firm*—Werner W. Kleeman

[57] ABSTRACT

To each panel is associated a panel suspension and guiding arrangement which comprises rollers cooperating with at least one guiding rail and through which the panel is slidably supported on the door frame. An extension of the guiding rails laterally beyond the door frame is avoided, in closing position of the door, through the provision of the panel suspension and guiding arrangement which is constructed to comprise a fixed guiding rail along which moves at least one roller movable with the panel, and a guiding rail movable with the panel and displaceable over a roller fixed in position. Such an arrangement facilitates the transportation, the handling and the mounting of doors, namely fully equipped landing doors, whether they be of the central opening or telescopic panel type.

2 Claims, 8 Drawing Figures

DOUBLE PANEL SLIDING DOOR, ESPECIALLY FOR ELEVATORS

BACKGROUND OF THE INVENTION

The present invention relates to an improved construction of double panel sliding door, namely a door for an elevator for humans, for a cargo or goods-lift or the like, with a door frame and, associated with each panel, a panel suspension and guiding arrangement including rollers cooperating with at least one guiding rail, by means of which the panel is supported by the door frame.

In known double panel sliding doors, each panel is carried by the door frame by means of a panel guiding and suspension arrangement which comprises at least one guiding rail provided on the upper part of the door frame, on which there are displaceable rollers carried by the panel or by a support member secured at the upper end of the panel. Such sliding doors are illustrated, for example, in Swiss Pat. Nos. 365,844 and 369,567. This known arrangement has the inconvenience of requiring that the guiding rails extend laterally beyond the door frame. This is so because in the open position of the panels they must be supported by the guiding rails almost entirely beyond the frame of the door. While in the case of telescopic double panel doors, these extensions are necessary on only one side of the frame of the door, they are provided on both sides when the doors are of the central opening type, that is when their panels slide on the guiding rail in opposite directions. These guiding rail portions that extend beyond the frame of the door are cumbersome, namely they render the transportation of complete doors more difficult, are bothersome during loading on a transportation vehicle as well as during the handling of the doors at building sites or at different floors of buildings under construction where the doors must be installed. During transportation or handling, it may happen that the guiding rail portions extending beyond the frame become warped or damaged. Furthermore, particularly with respect to landing doors providing a wide opening, it is often necessary that these guiding rail parts be secured to the masonry.

SUMMARY OF THE INVENTION

Therefore, an important object of the present invention is to avoid these difficulties.

Another more specific and significant object is to provide for sliding door equipment, a panel suspension and guiding arrangement with which, when the door is closed, the guiding rails thereof do not extend laterally beyond the door frame.

Still a further significant object of the present invention is to provide a double panel sliding door arrangement which is relatively simple in construction and design, extremely reliable in operation, not readily subject to breakdown or malfunction, requires a minimum of maintenance and servicing, and is convenient to transport and handle.

Now in order to implement these and still further objects of the invention, which will become more readily apparent as the description proceeds, the double panel sliding door of the present development is manifested by the features that, at least one panel is associated with a related panel guiding arrangement which comprises at least one roller which is fixed in position and over which there is displaceable a guiding or guide rail movable in conjunction with the panel, and at least one roller which is movable in conjunction with the panel and which is displaceable upon a fixed guide or guiding rail.

Some of the more notable advantages realized with the invention reside in the fact that the doors may be transported when equipped with their panels in pre-adjusted condition in view of their slidable displacement and presented in the form of compact assemblies which do not give rise to any handling and stacking problems when loaded on a transportation vehicle. The installation at the respective floors, when it comes to landing doors, additionally may be carried out with a minimum of operations and an appreciable saving in time. Moreover, in all cases, there is no necessity to secure the guiding rails to the masonry.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
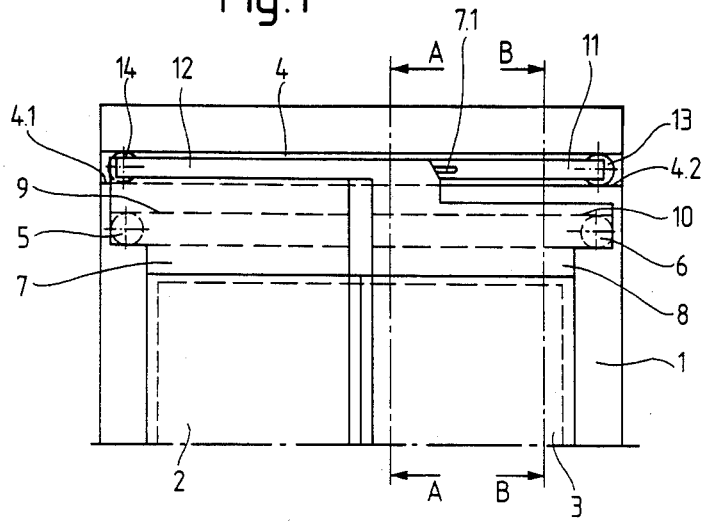
FIG. 1 is a schematic view in elevation illustrating, from the rear and in closure position, the upper part of a two-panel sliding door constructed according to a first exemplary embodiment of the invention.
Figure 2:
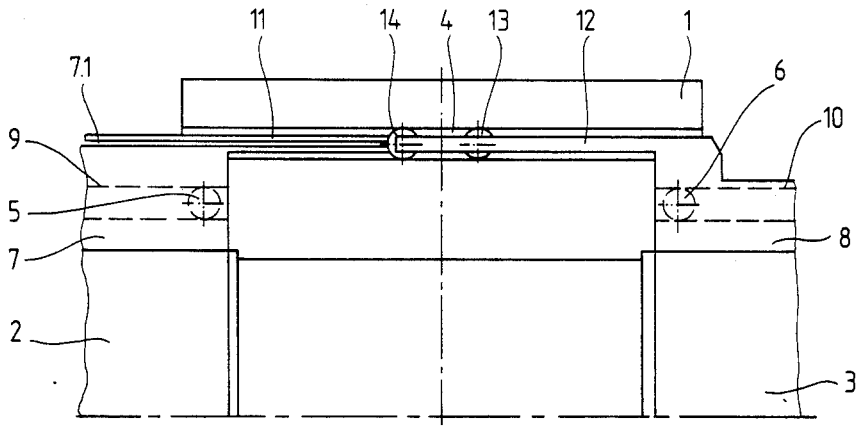
FIG. 2 is a view similar to that of FIG. 1, the door being shown in open position.

Describing now the drawings, in the exemplary illustrated embodiment of FIGS. 1 to 4, reference numeral 1 designates a door frame obtained, for instance, by assembling or welding elements made of bent or profiled sheet metal. The door frame 1 is adapted to support the panels 2 and 3 of an elevator landing door having two identical sliding panels capable of being automatically displaced in opposite directions and at the same time as the cage doors, by means of a not particularly shown but conventional mechanism actuated by a driving device carried by the cage. There are provided, at the top of the door frame 1, two guide or guiding rails 4.1, 4.2 which take the form of a single continuous guide or guiding rail 4 secured to the door frame 1. Beneath each end of the guide rail 4, and at a certain distance therefrom, there is provided a respective guide roll or roller 5, 6 rotatably mounted on a not particularly referenced axle secured to the door frame 1.

Figure 3:
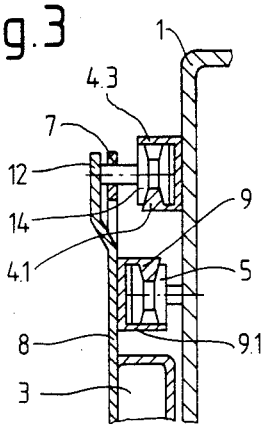
FIGS. 3 and 4 are partial transverse cross-sectional views, on a larger scale, taken respectively along lines A—A and B—B of FIG. 1.
Figure 4:
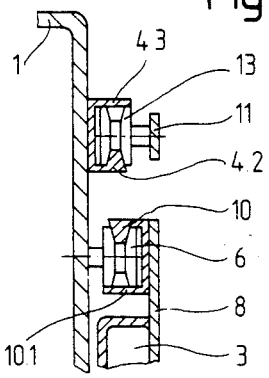
Figure 5:
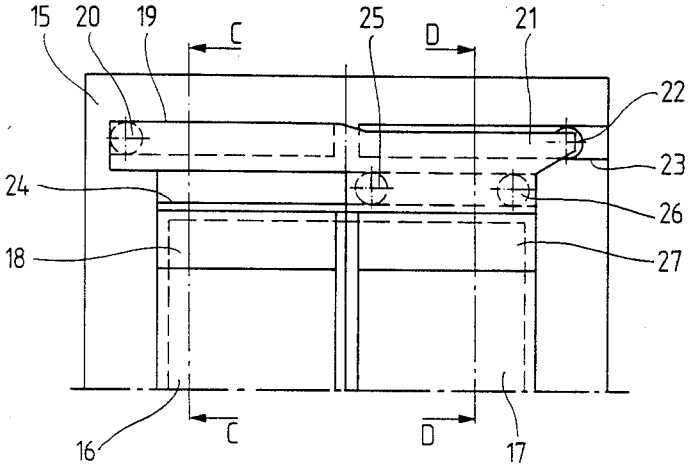
FIG. 5 is a schematic view in elevation illustrating, from the rear and in closure position, the upper part of a two-panel sliding door constructed according to another exemplary embodiment of the invention.
Figure 6:
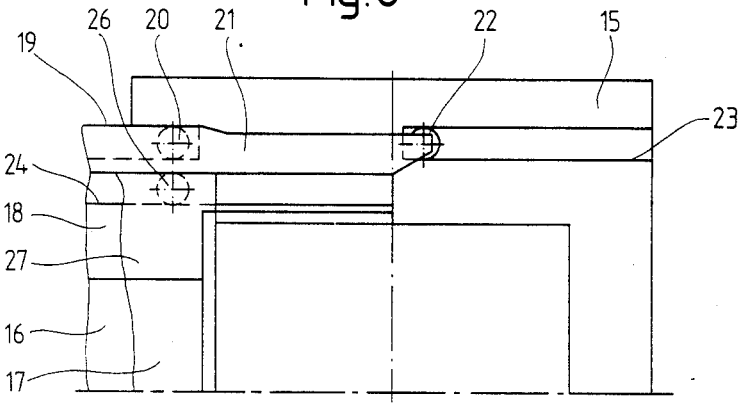
FIG. 6 is a view similar to that of FIG. 5 illustrating the door in open position.
Figure 7:
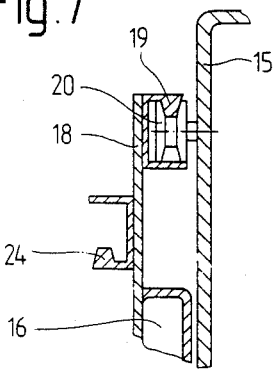
FIGS. 7 and 8 are partial views in transverse cross-section, on a larger scale, respectively taken along lines C—C and D—D of FIG. 5.
Figure 8:
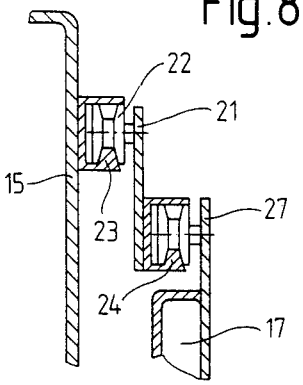

Reference numerals 7 and 8 respectively designate cross members or traverses secured to the upper part of the panels 2 and 3. To each cross member 7 and 8 there is secured a guide rail 9 and 10, respectively, which covers substantially the width of the corresponding panel and slightly extends beyond it so that it may move, during closure as well as opening of the door, on the corresponding roll or roller 5 and 6 carried by the door frame 1. On the side looking toward the other panel, each cross member 7 and 8 has an extension in the form of arms 11 and 12, respectively, of which the length is slightly greater than the width of a panel and at the end of which there is housed a rotating roller 13 and 14, respectively, which seats on the guide rail 4 secured to the door frame 1. As shown in FIGS. 1 and 3, the arm 12 which is an extension of the cross member 8 of the one panel 3 is set back and overlaps the cross member 7 secured to the other panel 2, through which, to allow for free displacement of the corresponding roller 14, there extends an elongated slot 7.1. The guide rail 4 secured to the door frame 1 and the two guide rails 9 and 10 movable with the panels 2 and 3 each have an opposite rail part 4.3, 9.1, 10.1 for the rollers 13, 14 and 5, 6 (FIGS. 3 and 4).

The stationary rollers 5, 6 carried by the door frame 1, the guide rails 9, 10 movable with the panels 2, 3, the movable rollers 13 and 14 carried by the respective arms 11 and 12 and the two fixed guide or guiding rails 4.1, 4.2 formed by the continuous rail 4 constitute two panel guiding and suspension arrangements in which, in the closure position of the door, no part of the guide rail extends beyond the frame of the door.

FIGS. 5 to 8 illustrate a further embodiment of the invention which is applicable to an elevator landing door having two telescopic panels, that is two panels slidable in the same direction. Reference numeral 15 designates a door frame adapted to support two panels 16, 17 capable of being displaced at different speeds and through different length displacement paths by means of a conventional displacement mechanism (not shown) actuated from the elevator cage. At the upper part of the slow moving panel 16 there is secured a cross member or traverse 18, which, as in the preceding embodiment, carries a guide rail 19 capable of moving on a roller 20 rotatably mounted on a not particularly referenced axle or the like secured to the door frame 15. The cross member 18 is likewise provided with an extension in the form of an arm 21, at the end of which there is rotatably mounted a roller 22 movable on a fixed guide rail 23 carried by the door frame 15 in the same plane as the movable guide rail 19.

On the face thereof opposed to that carrying the guide rail 19, the cross member 18 secured to the slow moving panel 16 carries a guide rail 24, which extends over the width of the two panels 16 and 17 and on which may be displaced rollers 25 and 26 rotatably mounted on a cross member 27 secured to the upper part of the fast moving panel 17. The latter is thus slidably carried by the slow moving panel 16.

Another advantage resulting from the invention resides in the fact that, in all cases, the total length of the guide rail required for each panel does not exceed the width of the door frame. This results in a door construction which is lighter.

Although the invention is more particularly applicable to landing doors of which the door frame must be secured to the masonry of a casing opening, it likewise relates to cage doors which are carried by the intermediary of a cage frame. Also, the expression "two-panel sliding door" extends to and encompasses doors provided with panels that are displaceable in opposite directions where each panel is itself made up of two telescopic parts.

In the two embodiments described above, the elements essential to the achievement of the invention have been shown in a simplified form. It goes without saying that more complex constructions and within the skill of the person initiated in the art may be foreseen within the framework, teachings and principles of the invention. Thus, the guide rails as well as the support elements, and the cross members associated with the panels or the door frames, may be obtained from bent or otherwise profiled sheet metal shapes. Similarly, the required joints between the elements may be obtained either by mechanical assembly or by welding.

While there are shown and described present preferred embodiments of the invention, it is to be distinctly understood that the invention is not limited thereto, but may be otherwise variously embodied and practiced within the scope of the following claims.

Accordingly, What I claim is:

1. A double panel sliding door for a transportation system, especially for passenger and cargo elevators and the like, having a door frame, comprising:

a pair of panels;

a panel suspension and guiding arrangement provided for each panel of said pair of panels;

at least one of said panel suspension and guiding arrangements comprising:

a fixedly positioned roller mounted at the door frame;

a guide rail movable in conjunction with a related one of said pair of panels;

said movable guide rail being displaceable over said fixedly positioned roller;

an arm carried by said related panel;

a movable roller mounted at an end of said arm;

a fixed guiding rail mounted at the door frame and provided with two opposite rail parts between which said movable roller is displaceable;

said pair of panels are each provided with substantially identical door panel suspension and guiding arrangements;

said pair of panels being slidable in opposite directions;

each said arm of each panel carrying the related movable roller being reversed in orientation from one panel to the other; and said fixed guiding rails of said pair of panels jointly defining a continuous single guiding rail for said movable rollers.

2. The double panel sliding door as defined in claim 1, wherein:

said movable roller defines an upper side thereof, a lower side thereof and a lateral direction thereof; and said two opposite rail parts of said fixed guiding rail being structured to guide each said movable roller at said upper side and said lower side and in said lateral direction.

* * * * *